US005482121A

United States Patent [19]

Draney et al.

[11] Patent Number: 5,482,121

[45] Date of Patent: Jan. 9, 1996

[54] VIBRATORY CABLE PLOW ASSEMBLY

[75] Inventors: Robert G. Draney; James W. Donoghue, both of Wichita; Mark D. Bird, Clearwater; David W. Beatenbough, Wichita, all of Kans.

[73] Assignee: Case Corporation, Racine, Wis.

[21] Appl. No.: 154,305

[22] Filed: Nov. 18, 1993

[51] Int. Cl.[6] ..... E02F 5/02

[52] U.S. Cl. ..... 172/40; 172/165; 405/182

[58] Field of Search ..... 37/356, 373, 376; 172/40, 56, 165, 667, 699, 735; 405/174, 180–183

[56] References Cited

U.S. PATENT DOCUMENTS

| | | | |
|---|---|---|---|
| 3,363,423 | 1/1968 | Davis | 61/72.6 |
| 3,618,237 | 11/1971 | Davis | 172/40 X |
| 3,935,712 | 2/1976 | Erickson et al. | 172/40 X |
| 4,102,403 | 7/1978 | Steinberg | 172/40 |
| 4,164,982 | 8/1979 | Draney | 172/40 |
| 4,239,085 | 12/1980 | Venable et al. | 172/667 |
| 4,318,445 | 3/1982 | Schuck | 172/667 X |
| 4,377,914 | 3/1983 | Draney et al. | 37/193 |
| 4,588,034 | 5/1986 | Leonard et al. | 172/40 |
| 4,867,607 | 9/1989 | Johnson et al. | 172/40 X |
| 4,871,027 | 10/1989 | Lindstrom et al. | 172/40 |
| 4,909,333 | 3/1990 | Lindstrom | 172/40 |

*Primary Examiner*—Dennis L. Taylor
*Assistant Examiner*—Robert Pezzuto
*Attorney, Agent, or Firm*—Rudnick & Wolfe

[57] ABSTRACT

A vibratory cable plow assembly including a frame assembly for connecting a plow blade to a frame of a prime mover. The frame assembly supports a vibrating mechanism or shaker that is adapted to impart vibratory movements to the plow blade. The frame assembly includes a lower support that extends rearwardly from its pivotal connection to the frame of the prime mover. The lower support mounts a blade supporting frame for rocking movement about a generally horizontal pivot mechanism. The blade supporting frame is mounted toward a distal end of the lower support intermediate its free ends and has the plow blade attached to a free end thereof. The vibratory mechanism is mounted on the blade supporting frame. An extendable/retractable driver extends about the lower support and is pivotally connected between the frame of the prime mover and the other free end of the blade supporting frame. An elastomeric bearing assembly isolates the blade supporting frame from transferring vibrations to the prime mover. A mounting promotes attachment of the frame assembly to the frame of the prime mover and facilitates horizontal movement of the plow blade relative to the frame of the prime mover.

21 Claims, 5 Drawing Sheets

VIBRATORY CABLE PLOW ASSEMBLY

FIELD OF THE INVENTION

The present invention generally relates to vibrating cable plow assemblies and, more particularly, to an apparatus for attaching a vibrating cable plow blade to a prime mover.

BACKGROUND OF THE INVENTION

Vibratory cable plows have been used for several years to lay cable, flexible pipe and the like beneath an upper surface of ground. The cable or pipe may be either pulled through the cut of the plow blade or a cable chute may be provided on the trailing edge of the plow blade for guiding the cable or pipe into the ground from a supply source preferably mounted on the tractor or other type of prime mover. Various types of vibrator assemblies or shakers have been connected to the plow blade to generate combined vertical/orbital motion thereby effectively reducing the drawbar pull or force required to pull the blade through the ground.

In a conventional cable-laying plow, the plow blade is supported by a frame assembly connected to the prime mover. The frame assembly typically includes two pairs of rigid and parallel side links that combine with forward and rearward frame members to form a parallelogram-type linkage assembly. The plow blade and vibratory assembly or mechanism are commonly supported by the rearward frame member. The vibrator assembly imparts substantially vertical vibrations in the plow blade when the prime mover is stationery and generally orbital vibrations in the blade as the blade is pulled through the ground. A hydraulic lift cylinder is connected to one pair of the side links for setting the depth of the plow blade and for raising the plow blade to a retracted or elevated position.

The rigidity of the links comprising a conventional plow blade frame assembly readily transfer vibrations to the prime mover thus causing discomfort for the operator. Moreover, the rigidity of the links comprising the frame assembly prevents the attack angle of the blade from changing during operation of the cable-laying plow. As may be appreciated, as the plow blade moves through the ground it occasionally tends to encounter large rocks, tree roots, and the like. The plow blade is often damaged as a result of its encounter with such subterranean conditions which are unobservable to the operator. Alternatively, when a plow blade encounters a large rock or tree root, the rigidity and nonforgiving nature of the frame assembly transfers vibrations and weight to the prime mover which can cause significant damage to the cable plow assembly and to the prime mover thus resulting in downtime to effect repairs and/or replacement of damaged or broken parts.

Thus, there is a need and a desire for a vibratory cable plow assembly wherein the plow blade is mounted by structure capable of reducing damage to the prime mover resulting from the plow blade unexpectedly engaging with subterraneous conditions and wherein vibrations imparted to the plow blade are isolated from being transmitted to the prime mover.

SUMMARY OF THE INVENTION

In view of the above, and in accordance with the present invention, applicants have recognized that there are considerable advantages to be gained in a cable plow assembly which incorporates an isolated blade support frame which is supported for rocking movement about a pivot mechanism under the influence of an extendable/retractable driver forming part of a frame assembly connecting a plow blade to a primary mover. The pivot mechanism preferably includes a cushioned beating assembly that isolates the blade supporting frame from the remainder of the frame assembly so as to limit the transmission of vibrations to the operator and to the prime mover. The extendable/retractable driver furthermore permits substantially infinite adjustment of the angle of the plow blade over a relatively wide range while at the same time permitting the plow blade to adapt to various subterranean conditions and physical restraints.

More specifically, the vibratory cable plow assembly of the present invention includes a generally flat elongated plow blade for cutting a relatively narrow continuous slit in the ground as the prime mover moves thereover. The blade is fixed at one end of a frame assembly which is structured to minimize vibration transfer to the prime mover. The frame assembly supports a vibratory mechanism that is adapted to impart vibratory movements to the plow blade. The frame assembly preferably comprises a lower support that extends rearwardly and away from its pivotal connection to the frame of the prime mover. Toward a distal end thereof, the lower support mounts a blade supporting frame for rocking movement about the generally horizontal pivot mechanism. The blade supporting frame has the vibratory mechanism supported thereon. In the preferred form of the invention, the extendable/retractable actuator or driver extends above the lower support and is pivotally connected between the frame of the prime mover and the blade supporting frame for controlling the elevation of the plow assembly relative to the ground surface as a function of the operative length of the driver.

The horizontal pivot mechanism mounts the blade supporting frame for rocking movement relative to the lower support and comprises a shaft defining a generally horizontal axis about which the blade support frame moves. The shaft is journalled in a pair of laterally spaced elastomeric bearings nonrotatably mounted on opposite sides of the blade supporting frame in axial alignment relative to each other. In the preferred embodiment, each elastomeric bearing includes a sleeve which is surrounded by an elastomeric cushion for inhibiting the transfer of vibrations from the blade support frame to the lower support. The pivot pin is nonrotatably secured to the sleeves of the bearings and to the lower support such that rocking movements of the blade supporting frame relative to the lower support will cause each bearing to impart a torsional force to the blade support frame to facilitate ground penetration by the plow blade.

In a most preferred form of the invention, the lower support includes a linkage such as a yoke including a pair of laterally spaced anus which accommodate the blade support frame for rocking movement therebetween. The linkage is connected to the prime mover for generally vertical movement about a generally horizontal axis. Notably, the operative length of the driver can be adjusted as the prime mover is in motion thereby adjusting the depth of the slit or cut made by the plow blade.

The driver has one end adapted for pivotal connection to the prime mover and extends above the linkage. The opposite end of the driver is pivotally connected to an opposite end of the blade supporting frame such that distention/retraction of the driver causes rocking movements of the blade supporting frame and the elongated plow blade connected thereto relative to the lower linkage. The plow assembly further includes stops extending from the blade supporting frame and disposed for engagement with the linkage such that, upon retraction of the driver, the linkage will pivotally elevate and engage with the stops to move the blade to a retracted position. The plow assembly may further include a stop for limiting elevational movement of the linkage toward a retracted position.

To promote connection of the plow assembly to the prime mover, a mounting is provided in combination with the lower support and the extendable/retractable driver. The mounting includes a generally vertical connector which defines a common axis about which both the lower support and the driver pivotally move. The vibratory plow assembly according to the present invention may further include a swing motor for moving and positively positioning the plow in a generally horizontal direction relative to the generally vertical connector of the mounting.

Providing the driver as an integral structural member in the frame assembly that connects the plow blade to the frame of the prime mover allows the attack angle of the blade to be infinitely adjusted through a wide range of positions. As will be appreciated, angular disposition of the plow blade allows the blade to coact with the ground to set a plow depth which thereafter is maintained as long as the operative length of the cylinder remains constant. If, during operation, the plow blade should engage with a subterranean root or large rock, the cylinder permits deflection of the plow blade as through rocking movement of the blade support frame about its horizontal axis thereby inhibiting damage to the cable plow assembly and the prime mover. Moreover, including the driver as an integral component of the frame assembly, eliminates a totally rigid structure through which vibrations are transferred to the prime mover. Accordingly, the operator is provided with smoother operation with less vibration transfer.

As will be appreciated by those skilled in the art, the vibratory mechanism mounted on the blade mounting frame develops high frequency blade vibrations or reciprocatory movements that have been heretofore transmitted to the frame of the prime mover through the rigid links connecting the plow blade to the frame of the prime mover. Unlike other devices, the present invention includes a resilient elastomeric bearing assembly disposed between the blade mounting frame and the lower support structure thereby isolating the vibratory movements of the blade from the frame of the prime mover. The beating assembly furthermore reduces changes in the vibration characteristics during the blade depth adjustment.

Numerous other advantages and meritorious features of the present invention will be more fully understood from the following description of the preferred embodiment, the appended claims, and the following drawings.

DETAILED DESCRIPTION OF THE PRESENT INVENTION

Figure 1:
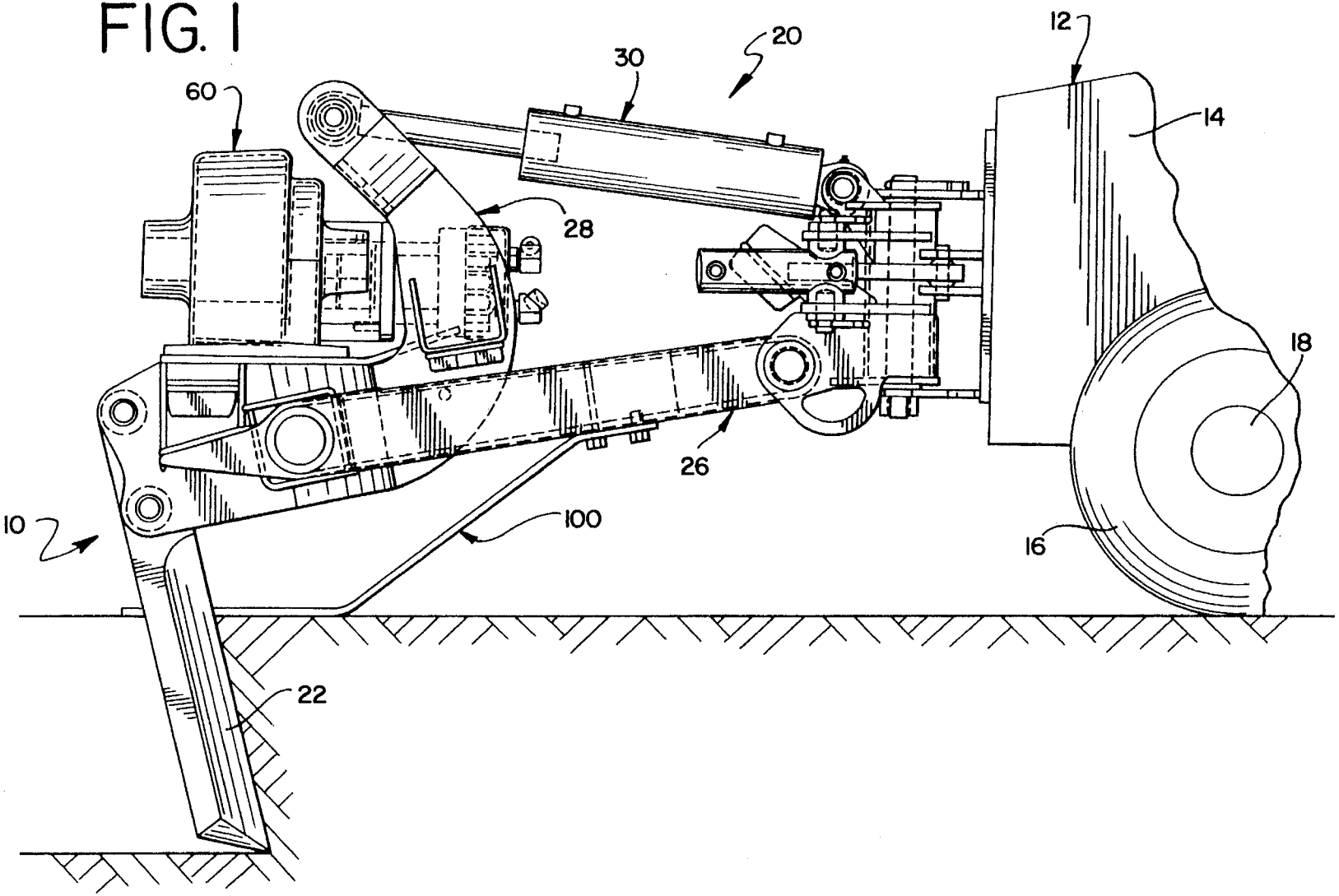
FIG. 1 is a schematic side elevational view of a vibratory cable plow assembly according to the present invention.

While the present invention is susceptible of embodiment in various forms, there is shown in the drawings and will hereinafter be described a preferred embodiment of the invention with the understanding that the present disclosure is to be considered as setting forth an exemplification of the invention which is not intended to limit the invention to the specific embodiment illustrated.

Referring now to the drawings, wherein like reference numerals refer to like parts throughout the several views, there is shown in FIG. 1 a vibratory cable plow assembly 10 which is constructed in accordance with the teachings of the present invention. The cable plow assembly 10 is attachable to a prime mover 12 such as a tractor, bulldozer or the like. More specifically, the cable plow assembly is attachable to a frame 14 of the prime mover. In the illustrated embodiment, the frame 14 of the prime mover 12 is suited for movement across a field by suitable ground engaging wheels 16 mounted on conventional axles 18.

The cable plow assembly includes a frame assembly 20 which connects a generally flat elongated plow blade 22 to the frame 14 of the prime mover. One longitudinal edge of the blade 22 is configured as a ground slitting edge. As is conventional, a cable guide (not shown) can be suitably supported in combination with the blade 22 for receiving a cable, conduit or flexible pipe which is continuously fed into and along the bottom or the ground slit formed by blade 14 as the prime mover moves over the surface of the ground.

Figure 2:
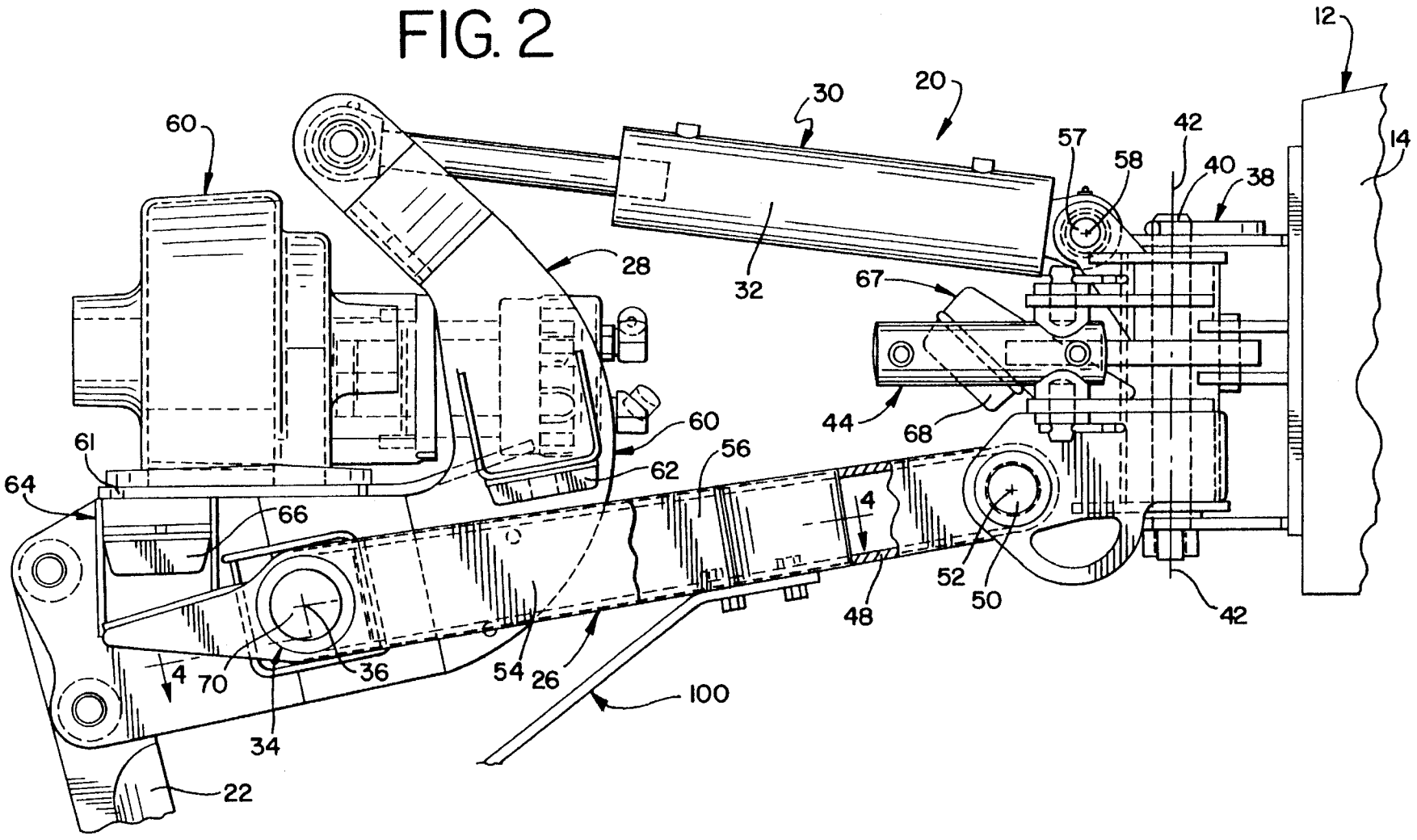
FIG. 2 is an enlarged side elevational view of the present invention.

As shown in FIG. 2, the frame assembly 20 of the present invention includes a lower fixed length support or frame member 26, a rear frame member 28 having the blade 22 connected thereto and which itself is connected to the lower support 26, and an upper frame member 30 preferably in the form of a extendable/retractable driver or actuator 32 of adjustable length. A horizontal pivot mechanism 34 mounts the rear frame member 28 toward the distal end of the lower frame member 26 for rocking movement about a generally horizontal axis 36. The frame members 26, 28 and 30 are connected to each other and to the frame 14 of the prime mover to permit elevational movements of the plow blade 22 between a lower operative position and an upper transport position.

In a most preferred form of the invention, the frame assembly 20 further includes a mounting 38 to which the lower support 26 and driver 32 are each attached in vertically spaced relation. The mounting 38 includes a common connector 40 that defines a generally vertical axis 42 about which the lower support 26 and driver 32 move to horizontally position the plow blade 22 relative to the frame 14. In a most preferred form of the invention, a swing motor 44 is provided to move and positively position the frame assembly 20 including the lower support 26 and driver 32 in a horizontal direction relative to the generally vertical pivot pin or connector 40.

Figure 3:
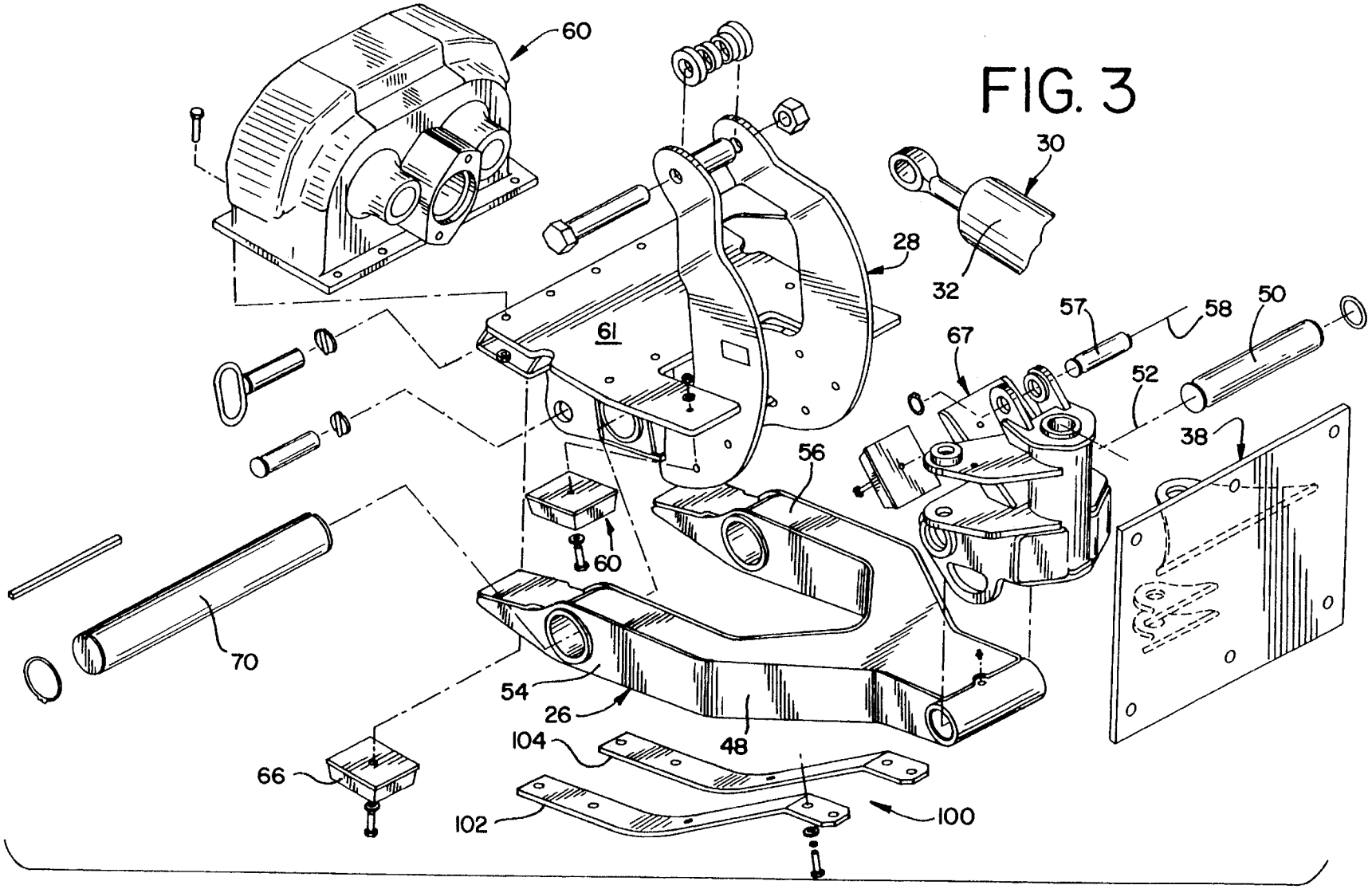
FIG. 3 is an exploded perspective view of the cable plow assembly of the present invention.

As shown in FIG. 3, the lower linkage 26 is preferably configured as a yoke 48. A forward end of yoke 48 is pivotally connected to the mounting 38 as by a suitable pin-type connector 50. The pin connector 50 permits vertical movement of the yoke 48 relative to the frame 14 (FIG. 2) of the prime mover about an axis 52. The distal end of yoke 48 is configured with a pair of laterally spaced arms 54 and 56.

Returning to FIG. 2, the blade mounting frame 28 preferably has a generally C-shape configuration and is mounted intermediate its free ends between and toward the distal ends of the arms 54, 56 of the lower linkage 26 by the horizontal pivot mechanism 34. The blade mounting frame 28 is mounted for rocking movement relative to the lower support 26 about the second generally horizontal axis 36 that extends generally parallel to the axis 52. An upper end of the plow blade 22 is fixedly supported to one free end of the frame 28. One end of the driver 32 is connected to the opposite free end of the frame 28.

A power driven vibratory mechanism or assembly 60 is supported on a platform 61 forming a part of the frame 28. The purpose of the vibratory mechanism 60 is to shake the frame 28 thereby imparting vertical reciprocatory movements to the blade 22 between upper and lower limits. Various types of vibrators or shakers may be utilized to generate the vibration in the blade 22 and reduce the drawbar pull or the force required to pull the blade through the ground to create the slit.

A forward end of the driver 32 is pivotally connected to the mounting 38 preferably by a suitable pin-type connector 57 defining a generally horizontal pivot axis 58 that is arranged above the first generally horizontal axis 52 of the lower support member 26. From its connection to the mounting 38, the driver 32 extends above the lower support member 26 and is articulately connected to the other free end of the frame 28. As will be appreciated, distention/retraction of the driver 32 results in rocking movements of the frame member 28 about the second generally horizontal axis 36 thereby permitting adjustment of the angle of the plow blade 22 relative to the lower frame member 26 within a predetermined range of movement.

In a preferred form of the invention, the driver or actuator 32 comprises a conventional hydraulically actuated cylinder. In a most preferred form of the invention, the driver includes a conventional hydraulically actuated double-acting cylinder which is selectively controlled by the operator such that the operative length of the cylinder can be readily changed as the prime mover 12 moves across the surface of the ground. For purposes of this application, the term "operative length" means the linear distance separating opposite ends of the actuator.

As will be appreciated, the elevation of the plow blade 22 is controlled as a function of the operative length of the driver 32. In the illustrated embodiment, the rear frame member 28 is provided with stops 60 disposed forwardly of the pivot axis 36 and which laterally extend outwardly from opposite sides thereof and above the lower frame member 26. The stops 60 are disposed for engagement with the lower frame member 26 such that upon retraction of the driver 32, the lower frame member 26 will engage with the stops 60 to elevate the blade to a retracted position. In a most preferred form of the invention, each stop 60 includes a rubber bumper 62 for cushioning the impact between the lower frame member and the rear frame member upon retraction of the driver 32.

In a most preferred form of the invention, the rear frame member 28 is further provided with laterally spaced stops 64 preferably carded on opposite sides of and beneath the platform 61 rearwardly of the pivot axis 36. The stops 64 are disposed for engagement with the distal ends of the arms 54, 56 of the yoke 48 thus limiting counterclockwise rocking movement of the blade mounting frame 28 as viewed in FIG. 2. The stops 64 preferably include a rubber bumper 66.

The frame assembly 20 is further provided with a stop 67 for setting an upper limit of vertical travel for the frame assembly 20 relative to the frame 14 of the prime mover 10. In a preferable form, the stop 67 is carded by the mounting 38 to positively engage with the retracted lower frame member 26 thereby setting the upper limit of travel of the yoke 48 and thereby setting the upper limit position of the frame assembly 20. In a most preferred form, an elastomeric bumper 68 is provided in combination with the stop 67 for cushioning the impact of the yoke 48 as it approaches its upper limit of travel relative to the mounting 38.

Figure 4:
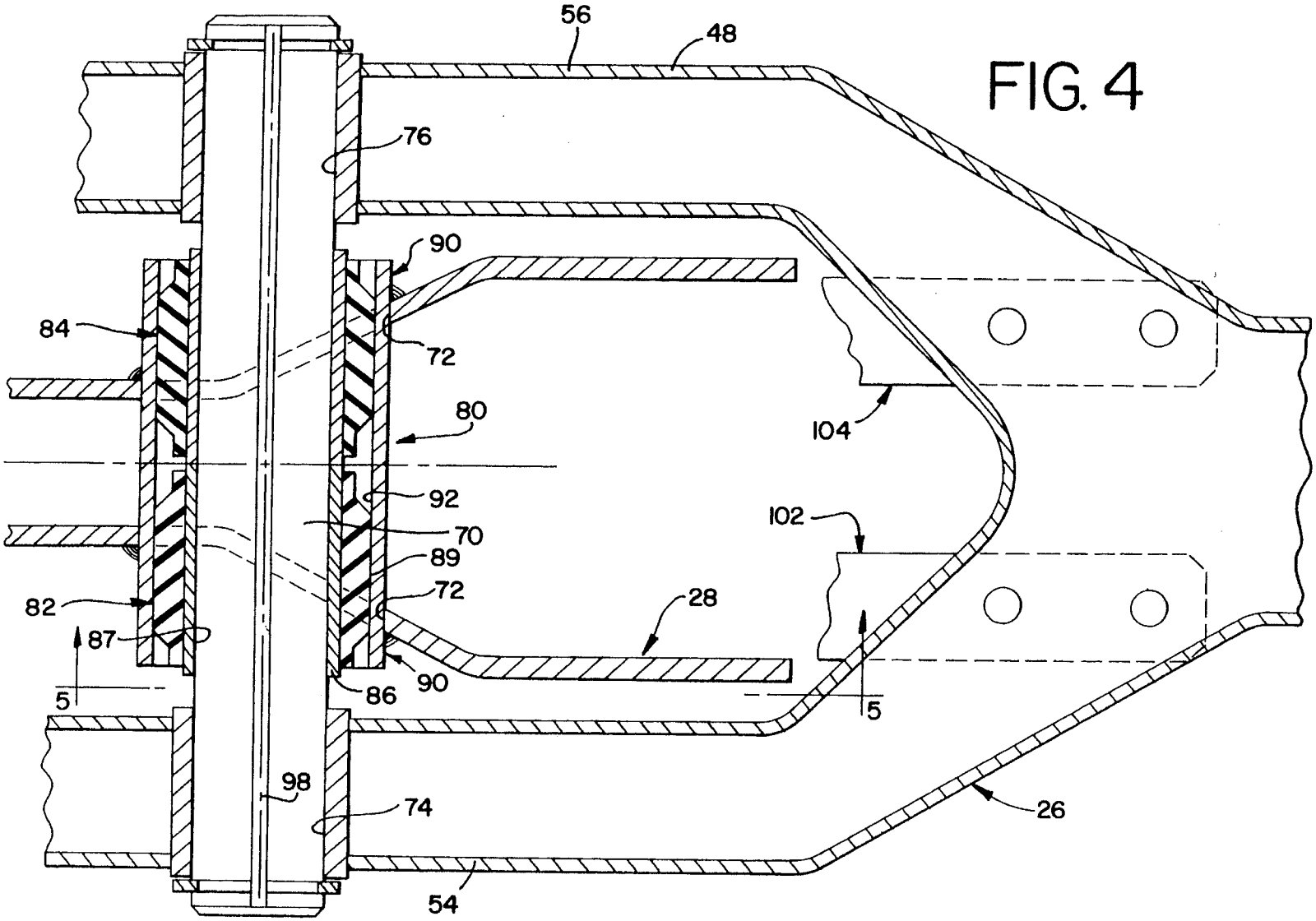
FIG. 4 is a sectional view taken along line 4—4 of FIG. 2.

The generally horizontal pivot mechanism 34 for mounting the rear frame member 28 for rocking movement about axis 36 preferably includes an elongated shaft 70. As shown in FIG. 4, shaft 70 passes through a suitable bore 72 in the rear frame member 28 and has opposite ends journalled in axially aligned bores 74, 76 defined at the distal ends of the arms 54, 56, respectively, of the yoke 48. To inhibit the transfer of vibrations to the frame 14 of the prime mover 10, the frame assembly 20 of the present invention preferably includes a single elastomeric bearing assembly 80 arranged between the vibrating rear frame member 28 and the lower frame member 26. The elastomeric bearing assembly 80 is preferably comprised of laterally spaced bearings 82 and 84 arranged in combination with the shaft 70 about which the rear frame member 28 rocks in response to change in the operative length of the driver 32. Each bearing 82, 84 is substantially similar in construction. Thus, only bearing 82 will be described in detail with the understanding that the other bearing 84 is substantially similar.

Each beating 82, 84 is a composite structure including a cylindrical sleeve 86 which is surrounded by an elastomeric cushion 88. Each sleeve 86 defines an internal bore 87 which is sized to establish a sliding fit over the outside diameter of shaft 70. The elastomeric cushion 88 is preferably fabricated from a rubber or rubber-like material having a Durometer hardness preferably in the range of 69 to 71 and has an outer surface 89 defining a specific configuration. As shown in FIG. 4, opposite lateral sides of the rear frame member 28 are each provided with substantially identical structures 90 that are centered on the bore 72 defined by the rear frame member 28. Each structure 90 extends laterally outward from the respective side surface of frame member 28 toward a respective arm of the lower frame member 26. In the illustrated embodiment, each structure 90 defines a cavity 92 having a configuration which corresponds to the outer surface configuration of the associated beating. As will be appreciated from a further understanding of the present invention, configurations other than that shown may be provided for each cavity 92 without departing or detracting from the spirit and broad scope of the present invention.

The sleeve 86 and cushion 88 of each beating 82, 84 are glued or otherwise fixedly secured to each other to inhibit relative rotation therebetween. Moreover, the sleeve 86 and cushion 88 of each beating 82, 84 have suitable lengths such that when inserted within the cavity 92 of a respective structure 90 the beatings 82, 84 are sufficiently sized to absorb the vibrations of the frame member 28 between the outer surface 89 of the cushion 88 and the inner surface 87 of the sleeve 86.

Figure 5:
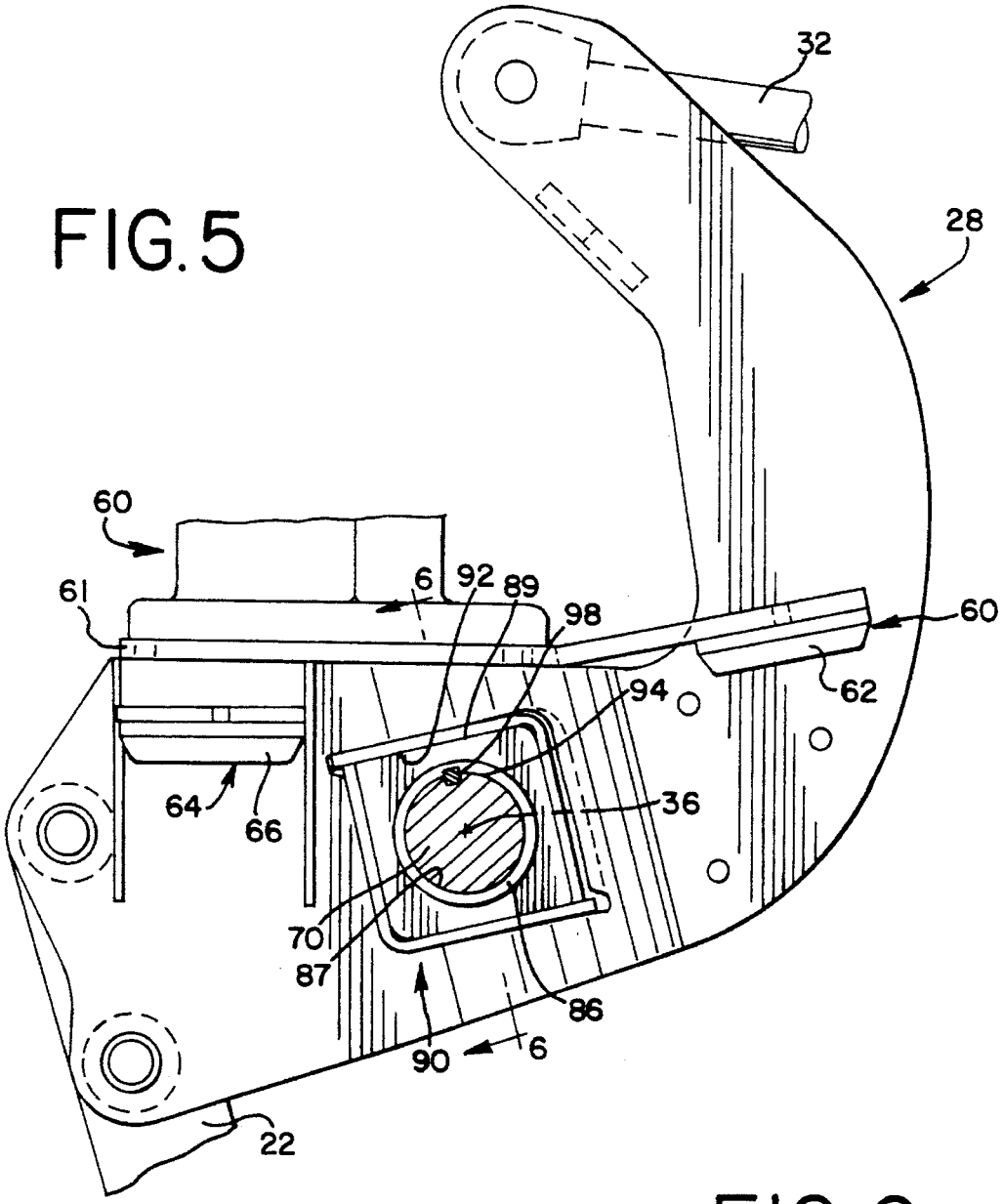
FIG. 5 is a sectional view taken along line 5—15 of FIG. 4.
Figure 6:
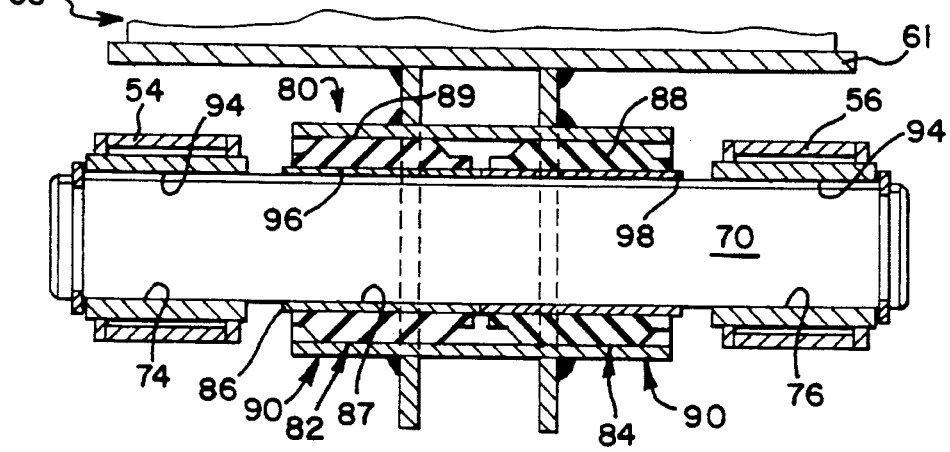
FIG. 6 is a sectional view taken along line 6—6 of FIG. 5.

The shaft 70 of the horizontal pivot mechanism 34 is nonrotatably fixed to the arms 54, 56 of yoke 48 and to each of the beatings 82, 84 of the bearing assembly 80. In the illustrated embodiment, the bores 74, 76 in arms 54, 56, respectively, of the yoke 48 are each preferably provided with a lateral slot or keyway 94. Similarly and as shown in FIG. 5, the internal bore 87 of each sleeve 86 of each beating 82, 84 is preferably provided with a lateral slot or keyway 96. As shown in FIGS. 5 and 6, a key 98 is held within the keyways 94 and 96 to nonrotatably secure the arms 54, 56 of yoke 48 to each of the beatings 82, 84 of the bearing assembly 80.

In a most preferred form of the invention, the frame assembly 20 further includes a bifurcated presser foot assembly 100 (FIG. 1) for inhibiting dirt and clods from being pulled out of the ground as a result of the reciprocating movements of the plow blade 22. As shown in FIG. 3, the presser foot assembly 100 preferably includes a pair of laterally spaced heavy leaf springs 102 and 104. The springs 102, 104 are of substantially identical configuration and are arranged on opposite lateral sides of the plan blade 22. The lower end of springs 102, 104 straddle blade 22. The upper end of springs 102, 104 are suitably attached to an underside of the yoke 48.

Attachment of the frame assembly 20 to the frame 14 of the prime mover 12 is facilitated by the mounting 38 which can be readily secured to the frame 14. In operation, the plow blade 22 can be raised, lowered, or tilted by operation of the driver 32. Upon distention of the driver 32, the lower frame support 26 rotates about its pivot axis 52 while the driver 32 rotates about its horizontal pivot axis 58 thereby lowering the blade 22 toward the ground surface. The stop 64 limits counterclockwise movement, as viewed in FIG. 2, of the rear frame member 28 about axis 36 and relative to the lower frame member 26.

Once the plow blade 22 penetrates the ground, the driver is operated in a "float" condition. That is, the angular disposition of the plow blade 22 relative to the ground surface will tend to set the depth of the plow blade. Advantageously, the angular disposition of the plow blade 22 can be altered or changed through extension/retraction of the driver 32 thereby rocking the rear frame member 28 about the horizontal pivot mechanism 34 and about axis 36. A further advantageous feature of the present invention being that the angular disposition of the plow blade 22 can be altered or changed as the prime mover moves across the ground surface thereby altering the depth of the plow blade as desired by the operator. As will be appreciated, the angular disposition of the plow blade 22 in one direction is limited by the stops 62 provided rearwardly of the horizontal pivot mechanism 34 and between the laterally spaced arms 54, 56 of yoke 48 and the rear frame member 28.

Retraction of driver 32 causes the rear frame member 28 to rock in a clockwise direction as seen in FIG. 2 about the horizontal pivot mechanism 34. The rocking movement of the rear frame member 28 continues until the stops 60 on the rear frame member 28 contact the yoke 48. Further retraction of the driver 32 will cause the yoke 48 to vertically elevate about axis 52 as well as causing movement of the driver or cylinder 32 about its pivotal connection 57 to the frame of the prime mover. Ultimately, the stop 67 on the mounting 38 engages with the yoke 48 thereby limiting the upward vertical travel of the frame assembly 20 and thereby arranging the blade 22 in a transport position.

In a preferred form of the invention, the plow blade 22 can be laterally positioned relative to the frame 14 of the prime mover 10. The connector 40 on the mounting 38 permits the frame members 26, 28 and 30 of the frame assembly 20 to swingably move in a horizontal direction to opposite sides of the vertical axis 42 of the mounting 38. The swing motor 44 serves to move and positively position the frame assembly 20 and thereby the plow blade 22 in a desired lateral position relative to the frame 14 of the prime mover.

As the plow blade 22 cuts a slit in the ground, it is impossible for the operator to judge subterranean conditions such as large rocks or tree roots that may be present and upon which the blade 22 may become snagged. Unlike prior devices, however, when the blade 22 happens upon a large rock or boulder, the forces imparted thereto cause rocking movement of the rear frame member 28 about the horizontal pivot mechanism 34. An advantage of the present invention being that the cylinder 32 is designed as a nonrigid frame member which permits limited rocking movement of the rear frame member 28 about the horizontal pivot mechanism 34 thus allowing the blade to clear buried objects and reduce or eliminate weight transfer to the axles 18 of the prime mover. Moreover, including the driver 32 as a nonrigid link in the frame assembly 20 reduces the transmission of vibrations to the frame 14 of the prime mover thereby improving ride characteristics and reducing resultant damage from such vibrations.

An inherent feature of the present invention requires the rear frame member 28 to vibrate under the influence of the vibratory mechanism 60 thereby imparting vibrations to the blade 22 to facilitate movement of the blade through the ground to cut the slit. An important aspect of the present invention concerns its ability to isolate the vibrating rear frame member 28 from the remainder of the frame assembly 20 thereby reducing the transmission of vibrations to the frame 14 of the prime mover. As will be appreciated, the single resilient elastomeric bearing assembly 80 operates in combination with the horizontal pivot mechanism 34 to substantially reduce the transmission of vibrations between the rear vibratory frame member 28 and the remainder of the frame assembly 22 connecting the plow blade to the frame 14 of the prime mover.

The beatings 82, 84 of bearing assembly 80 furthermore facilitate proper positioning of the plow blade 22. The bearings 82, 84 of the bearing assembly 80 automatically impart an advantageous torsional force upon the blade 22 when the rear frame member 28 rocks about the pivot mechanism 34 and relative to the lower frame member 26. As mentioned, the cushion 88 of each bearing 82, 84 is captively received within the cavity 92 formed by the respective structure 90 extending outwardly from opposite lateral sides of the frame member 28 and, thus, moves therewith upon rocking movement of the frame member. Moreover, the cushion 88 is nonrotatably secured to the respective sleeve 86 of each beating. Thus, when the frame member 28 rocks about the pivot mechanism 34, the structure 90 tends to rotate the cushion 88 of each beating 82, 84 therewith. The sleeve 86 of each beating 82, 84, however, is nonrotatably secured to the arms 54 and 56 of the yoke 48 and to the shaft 70 as through the combination of keyways 94 and 96, and key 98. Accordingly, a torsional force is created in each bearing 82, 84 upon rocking movement of the frame member 28 about the horizontal pivot mechanism 34. This torsional force serves to facilitate penetration of the blade 22 into the ground upon initial blade ground penetration and serves to maintain the plow blade in a fixed angular orientation relative to the lower frame member 26 as it is drawn through the ground to cut a slit for the cable.

From the foregoing, it will be observed that numerous modifications and variations can be effected without departing from the true spirit and scope of the novel concept of the present invention. It will be appreciated that the present disclosure is intended as an exemplification of the invention, and is not intended to limit the invention to the specific embodiment illustrated. The disclosure is intended to cover by the appended claims all such modifications as fall within the scope of the claims.

What is claimed is:

1. A vibratory cable plow assembly comprising:

a lower fore-and-aft elongated linkage including a pair of laterally spaced arms at a distal end thereof, with a proximal end of said linkage having a connection for allowing said linkage to be pivotally connected to a fore-and-aft extending frame of an off-highway implement such that the lower linkage is permitted to vertically move about a forward generally horizontal axis;

a frame connected intermediate its free ends between and for rocking movement relative to the laterally spaced arms of said lower linkage about a rearward generally horizontal axis spaced in a fore-and-aft direction from and extending generally parallel to said forward generally horizontal axis, said frame having an elongated plow blade connected to and extending in depending angular relation from a first free end, and wherein a second free end of said frame terminates vertically above the rearward horizontal axis thereof;

a vibratory assembly mounted on said frame for imparting vibratory movements to an elongated plow blade connected toward one end of said frame; and a linearly distendable/retractable driver having a proximal end adapted for pivotal connection to the frame of said implement, said driver extending above said lower linkage and is pivotally connected toward the second free end of said frame whereby distention/retraction of said driver causes rocking movements of the frame about the rearward axis thereby selectively modifying the disposition of said elongated plow blade relative to the lower elongated linkage.

2. The vibratory cable plow assembly according to claim 1 further including a mounting to which said linkage and said driver are attached in vertically spaced relation about a common pivot axis.

3. The vibratory cable plow assembly according to claim 2 further including a swing motor for laterally moving and positioning said linkage and said driver relative to a generally vertical connector defining a vertical axis and to which said linkage and said driver are commonly joined.

4. The vibratory cable plow assembly according to claim 1 further including stops extending from said frame and disposed for engagement with said linkage such that upon retraction of said driver said linkage will engage with said stops to elevate said blade to a retracted position.

5. The vibratory cable plow assembly according to claim 1 further including a stop for limiting elevational movement of the linkage assembly toward a retracted position.

6. The vibratory cable plow assembly according to claim 1 further including a resilient elastomeric bearing assembly arranged between said linkage and said frame for isolating the vibrations of said frame from being transmitted to said linkage assembly.

7. A vibratory cable plow assembly connected to a prime mover for forming a relatively narrow continuous slit in the ground as the prime mover moves along the surface thereof, said vibratory plow assembly comprising:

a fixed length lower frame member having a forward end pivotally connected to a frame of the prime mover to allow said lower frame member to vertically move relative to said frame about a first generally horizontal pivot axis, said lower frame member including a pair of arms arranged in laterally spaced relation relative to each other toward a rear end of said lower frame member;

a rear frame member mounted intermediate its ends for rocking movement about a second generally horizontal pivot axis between and relative to the laterally spaced arms of said lower frame member, said rear frame member including a portion that extends upwardly relative to the second generally horizontal pivot axis and terminates in a free end;

an elongated plow blade mounted to a free end of said rear frame member, one longitudinal edge of said blade being configured as a ground slitting edge; and an upper frame member of selectively adjustable length and extending above said lower frame member, said upper frame member being pivotally connected at one end to the frame of the prime mover and pivotally connected at an opposite end to an upper free end of said rear frame member, and wherein the length of said upper frame member can be adjusted on-the-go thereby resulting in rocking movements of said rear frame member about said second generally horizontal axis thereby permitting adjustment of the angle of the plow blade relative to said lower frame member.

8. The vibratory cable plow assembly according to claim 7 wherein said upper frame member comprises an extendable/retractable driver connected at opposite ends to the frame of the prime mover and to the free upper end of said rear frame member, and wherein the operative length of said driver controls the angular disposition of the plow blade relative to the lower frame member and thereby relative to the ground surface.

9. The vibratory cable plow assembly according to claim 8 wherein at least one of said rear frame member and said lower frame member includes structure that causes an interference between the members when said driver is retracted whereby moving said plow blade to a retracted position.

10. The vibratory cable plow assembly according to claim 7 further including a mounting to which said lower and upper frame members are pivotally connected for generally horizontal movement to opposite sides of a generally vertical pin defining a common pivot axis for the lower and upper frame members.

11. The vibratory plow assembly according to claim 10 further including a swing motor for moving and positively positioning said plow blade in a direction relative to said generally vertical pivot pin.

12. The vibratory cable plow assembly according to claim 7 further including a generally horizontal pivot mechanism carried by said lower frame member for mounting said rear frame member for rocking movement about a generally horizontal axis thereof, said pivot mechanism including resilient elastomeric bearings interposed between said lower and rear frame members for minimizing transfer of vibrating movements to the frame of the prime mover.

13. The vibratory cable plow assembly according to claim 7 wherein said lower frame member comprises a yoke having a pair of laterally spaced arms at the distal end of said yoke for accommodating said rear frame member for rocking movement therebetween.

14. A vibratory cable plow assembly connected to a frame of a prime mover for forming a relatively narrow continuous slit in the ground as the prime mover moves thereover, said vibratory plow assembly comprising:

a generally flat elongated plow blade for cutting said slit in the ground, said blade being fixed at one end of a frame assembly which supports a vibratory mechanism that imparts vibratory movements to said plow blade and which is structured to minimize vibration transfer to the prime mover; and wherein said frame assembly comprises a lower support that extends rearwardly and away from its pivotal connection to the frame of the prime mover, said lower support including, toward a distal end thereof, a horizontal pivot mechanism for mounting a blade supporting frame for rocking movement thereabout, said blade supporting frame having a support portion on which said vibratory mechanism is mounted and a free ended extension portion that upwards extends from a generally horizontal axis about which said blade supporting frame rocks, said horizontal pivot mechanism including a pivot pin defining the generally horizontal axis about which said blade supporting frame rocks and an elastomeric bearing assembly which journals said pivot pin and is arranged between said blade supporting frame and said lower support for inhibiting transmission of vibrations to said lower support from the vibratory mechanism, and a hydraulically actuated extendable/retractable cylinder extending above said lower support and pivotally interconnected between the frame of the prime mover and the free ended portion of said blade supporting frame for controlling elevation of the plow assembly relative to the ground surface as a function of the operative length thereof.

15. The vibratory cable plow assembly according to claim 14 wherein said frame assembly further includes a mount adapted to rigidly connect the frame assembly to the frame of the prime mover and to which the lower support and said cylinder are connected for movement about a common connector defining a generally vertical axis of rotation for the lower support and cylinder.

16. The vibratory plow assembly according to claim 14 wherein stops are provided on said blade supporting frame member for engagement with said lower support upon retraction of said cylinder whereby elevating said plow blade to a raised position.

17. The vibratory cable plow assembly according to claim 14 wherein said elastomeric bearing assembly includes a pair of elastomeric bearings nonrotatably mounted on opposite sides of the blade supporting frame for movement therewith, each elastomeric beating including a sleeve which is surrounded by an elastomeric cushion, and wherein said pivot pin is nonrotatably connected to said sleeve and is nonrotatably journalled in said lower support such that relative rocking movements between said blade supporting frame and said lower support causes said bearings to impart torsional forces to said plow .blade to facilitate ground penetration by said plow blade.

18. A vibratory cable plow assembly connected to a frame of a prime mover for forming a relatively narrow continuous slit in the ground as the prime mover moves thereover, said cable plow assembly comprising:

a generally flat elongated plow blade for cutting said slit in the ground;

a frame assembly for connecting said plow blade to the frame of the prime mover, said frame assembly comprising a mounting bracket, a fixed length rigid member attached to the mounting bracket for pivotal movement about a first generally horizontal pivot axis to permit vertical movement of the rigid member about said first axis, a blade mounting having said plow blade attached to one free end thereof, said blade mounting being mounted intermediate free ends thereof to a distal end of said rigid member for rocking movement about a second generally horizontal axis, and wherein the free ends of said blade mounting are arranged on opposite sides of said second generally horizontal axis in vertically spaced relation relative to each other, said blade mounting having a vibratory mechanism mounted thereon and intermediate the free ends thereof for imparting vibratory movements to said plow blade, and a hydraulic cylinder extending above said rigid member and having a first end pivotally connected to said mounting bracket above said first generally horizontal axis and a second end pivotally connected toward an opposite free end of said blade mounting for exerting upon said blade mounting a force tending to rock the blade mounting about the second generally horizontal axis thereby permitting substantially infinite adjustment of the angular disposition of the blade relative to the ground surface as the prime mover is in motion such that the plow blade penetrates the ground surface and positions itself to a depth related to the angle of blade inclination set by the operative length of the cylinder and maintains said depth as long as the operative length of the cylinder remains constant.

19. The vibratory cable plow assembly according to claim 18 wherein said mounting bracket further includes a generally vertical connector defining a generally vertical axis about which the rigid member and cylinder commonly move.

20. The vibratory plow assembly according to claim 19 further including a swing motor for swingably moving and positively positioning said plow blade relative to the vertical connector of said mounting bracket.

21. A vibratory cable plow assembly comprising:

a generally flat elongated plow blade for cutting a slit in the ground, said blade being supported at one end of a linkage assembly which supports a vibratory mechanism that imparts vibratory movements to said blade; and wherein said linkage assembly comprises a lower support defining a pivotal mounting portion toward one end thereof, a blade supporting frame having said vibratory mechanism mounted thereon and with said plow blade being attached toward a first free end of said blade supporting frame, a hydraulically actuated cylinder extending above said lower support and connected to a second free end of said blade supporting frame, and a horizontal pivot mechanism pivotally interconnected intermediate the free ends of and for mounting said blade supporting frame to a distal end of the lower support to allow for rocking movements of said blade supporting frame about a fixed generally horizontal axis in response to changes in the effective length of said cylinder, and wherein said lower support remains fixed for a range of rocking movement of the blade supporting frame and said plow blade, said pivot mechanism comprising a pivot pin which defines the axis about which said blade support frame rocks, and a pair of elastomeric bearings nonrotatably mounted on opposite sides of the blade supporting frame in axial alignment relative to each other, each elastomeric bearing including a sleeve which is surrounded by an elastomeric cushion for inhibiting the transfer of vibrations from said blade support frame to said lower support, and wherein said pivot pin is nonrotatably secured to said sleeves and to said lower support such that rocking movements of said blade supporting frame relative to said lower support will cause each bearing to impart a force to the blade support frame to facilitate ground penetration by said plow blade.

* * * * *